US009719266B2

(12) United States Patent
Lopez

(10) Patent No.: US 9,719,266 B2
(45) Date of Patent: Aug. 1, 2017

(54) SURFACE FINISHING TOOL

(71) Applicant: Gilbert Lopez, Normal, IL (US)

(72) Inventor: Gilbert Lopez, Normal, IL (US)

(73) Assignee: CONKLO CONCRETE CONSTRUCTION, Englewood, CO (US)

( * ) Notice: Subject to any disclaimer, the term of this patent is extended or adjusted under 35 U.S.C. 154(b) by 21 days.

(21) Appl. No.: 14/715,004

(22) Filed: May 18, 2015

(65) Prior Publication Data

US 2015/0330090 A1 Nov. 19, 2015

Related U.S. Application Data

(60) Provisional application No. 61/994,578, filed on May 16, 2014.

(51) Int. Cl.

| | |
|---|---|
| ***E04F 21/165*** | (2006.01) |
| ***E04F 21/24*** | (2006.01) |
| ***E04G 11/36*** | (2006.01) |

(52) U.S. Cl.

CPC ..... *E04F 21/24* (2013.01); *E04F 21/1655* (2013.01); *E04F 21/244* (2013.01); *E04G 11/36* (2013.01)

(58) Field of Classification Search

CPC ..... E04F 21/1655; E04F 21/24; E04F 21/244; E04G 11/36

See application file for complete search history.

(56) References Cited

U.S. PATENT DOCUMENTS 1,564,172 A * 12/1925 Busch ..... E01C 19/44 15/235.8

* cited by examiner

*Primary Examiner* — Shay Karls

(74) *Attorney, Agent, or Firm* — Greer, Burns & Crain, Ltd.; Steven P. Fallon

(57) ABSTRACT

A finishing tool with an elongate body having a finish side and a grip side. The finish side provides a finish edge configured to form a flat concrete surface when pulled across partially set concrete. The grip side is configured to be gripped by a user. A radius notch on one end of the finish side is configured to provide a rounded edge transition above the flat concrete surface when pulled across the partially set concrete. The finish edge is configured to be sloped running away from the radius notch. An adjustable form gage can be attached to an opposite end of the elongate body from the radius notch. The adjustable form gage defines a foot with a form surface configured to interface with a form. The adjustable form gage is adjustable within a predetermined range to set the finish edge at a predetermined pitch.

14 Claims, 4 Drawing Sheets

SURFACE FINISHING TOOL

PRIORITY CLAIM AND REFERENCE TO RELATED APPLICATION

The application claims priority under 35 U.S.C. §119 from prior provisional application Ser. No. 61/994,578, which was filed May 16, 2014.

FIELD

A field of the invention is tools, and particularly surface finishing tools. A particular preferred tool is a concrete finishing tool. A particular example application of a tool of the invention is finishing a concrete edge with a shape that provides a liquid barrier.

BACKGROUND

Particular areas of concrete finishing are labor intensive. Transition areas are an example. A transition area is, for example, in the area of a garage floor that transitions to outside. This is the area where a door with a seal will meet the concrete. It is desirable for the door seal to meet an apron that is below the garage floor and for the apron to be pitched downward toward the outside. This provides a water barrier when the seal on the bottom of the garage door meets the apron. It is also desirable for the end of the garage floor portion be curved and have a small pitched section.

Compared to the form structures and labor steps needed to create and pour the garage floor or a driveway, the steps required to create the transition area are labor and form intensive in view of the relatively small area occupied by the apron. Normally, an additional form is set at a distance away from the garage floor for creating the apron. A typical distance is 14 inches. Thus, a separate form structure is used to create an apron that is only 14" wide. In addition, the edge of the garage floor is often manually shaped with a variety of conventional and improvised tools. For example, an edger tool can be used to form a radius on the edge of the garage floor. However, then separate finishing is still required for the apron portion. This added labor makes the job more expensive and time consuming. It also produces inconsistent results. When done poorly, the desired liquid barrier can be compromised.

SUMMARY OF THE INVENTION

An embodiment of the invention is a finishing tool with an elongate body having a finish side and a grip side. The finish side provides a finish edge configured to form a flat concrete surface when pulled across partially set concrete. The grip side is configured to be gripped by a user. A radius notch on one end of the finish side is configured to provide a rounded edge transition above the flat concrete surface when pulled across the partially set concrete. The finish edge is configured to be sloped running away from the radius notch.

In preferred embodiments, an adjustable form gage is attached to an opposite end of the elongate body from the radius notch. The adjustable form gage defines a foot with a form surface configured to interface with a form. The adjustable form gage is adjustable within a predetermined range to set the finish edge at a predetermined pitch.

DESCRIPTION OF THE PREFERRED EMBODIMENTS

Figure 1:
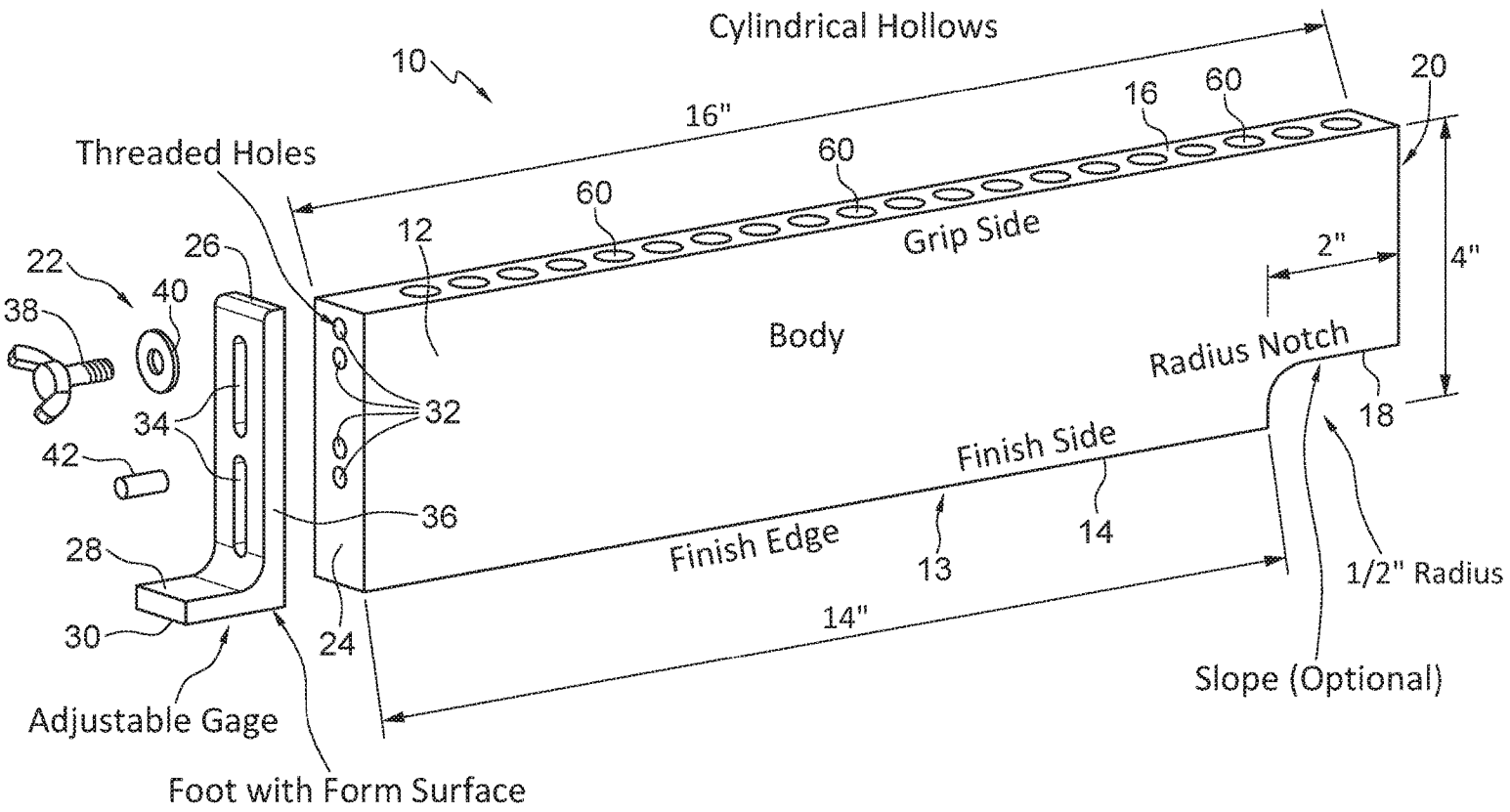
FIG. 1 is a perspective view of a preferred embodiment finishing tool of the invention.

Finishing tools of the invention provide the ability to simultaneously provide a finished and radius edge transition for a first concrete surface and a slope on a second concrete surface away from the first concrete surface. Tools of the invention can reduce the number of forms required, and the required labor to form an apron and finish the end of a garage floor, for example. An embodiment of the invention is a finishing tool with an elongate body having a finish side and a grip side. The finish side provides a finish edge configured to form a flat concrete surface when pulled across partially set concrete. The grip side is configured to be gripped, conveniently and comfortably, by a user. A radius notch on one end of the finish side is configured to provide a rounded edge transition above the flat concrete surface when pulled across the partially set concrete. The finish edge is configured to be sloped running away from the radius notch.

In preferred embodiments, an adjustable form gage is attached to an opposite end of the elongate body from the radius notch. The adjustable form gage defines a foot with a form surface configured to interface with a form. The adjustable form gage is adjustable within a predetermined range to set the finish edge at a predetermined pitch. Other embodiments provide a fixed pitch and can be unitary, single piece structures.

The finishing edge in preferred embodiments is elongate and preferably straight. Additional features can be included, e.g., notches. In addition, the finishing edge and all edges of the body can have small radiuses, though not apparent in the figures. The grip side can also optionally have a handle, though not shown in the figures. The radius edge and the finish edge combine to produce a precise predetermined radius garage floor edge that transitions to a sloped apron. The finish edge is configured, for example with a gage, to have a slope that is downward away from the notch. The preferred embodiment uses an adjustable gage that can be set to two or more specific predetermined positions that set predetermined slopes for an apron.

The tool is easily adjusted and reused. It can be cleaned. The adjusting gage in preferred embodiments is removable, which aids in cleaning, but that is not necessary in other embodiments. An advantage of having the gage permanently attached in other embodiments is that the gage is less likely to be misplaced on job sites.

Preferred embodiments of the invention will now be discussed with respect to the drawings. The drawings may include schematic representations, which will be understood by artisans in view of the general knowledge in the art and the description that follows. Features may be exaggerated in the drawings for emphasis, and features may not be to scale.

FIG. 1 shows a preferred embodiment finishing tool 10. Exemplary dimensions provided on the tool concern a preferred embodiment, but do not limit the invention in its broader aspects. An elongate body 12 has a finish side 13 and a grip side 16. The finish side 13 defines a finish edge 14 configured to form a flat concrete surface when pulled across partially set concrete (or other materials that take a set over time). The grip side 16 is configured to be gripped by a user. The grip side 16 and body 12 in general are dimensioned to be comfortably and conveniently gripped. While the body 12 is shown to be symmetrical and generally rectangular, the grip side 16 can include other features or shapes to conform to a person's hand. A separate grip can also be attached to the grip side 16, and can be made from other materials. A radius notch 18 is on one end of the finish side 14 and is configured to provide a rounded edge transition on a first concrete surface that is above a second flat concrete surface when the tool 10 is pulled across partially set concrete. The finish edge 14 is configured to be sloped running down an away from the radius notch 18. This slope can be a unitary part of the finish edge, or the slope can be set by adjustment features. Additionally, the radius notch is optionally sloped up toward a first end 20 of the tool, which can provide a sloped edge transition on a first concrete surface.

The tool 10 includes a slope adjustment mechanism 22 at a second end 24 of the tool 10 that is opposite the first end 20. The slope adjustment mechanism 22 is in the form of an adjustable form gage 26 that can be attached to the second end 24 opposite the first end 20 of the elongate body 10. The adjustable form gage 26 have a foot 28 with a form surface 30 configured to interface with a form. The body 10 includes threaded holes 32 to accept hardware to attach and adjust the gage 26. For example, the gage 26 includes two slots 34 in an upper portion 36 that is generally perpendicular to the foot 28. A winged threaded bolt 38 passes through a washer 40 and an upper one of the slots 34 to thread into an upper one of the holes 34. A second bolt can be used, or as shown in FIG. 1, a pin 42 can be removable or permanently set into a lower one of the holes 34. Loosening the bolt 38 allows sliding adjustment of the gage 26 up and down relative to the body, which creates a predetermined range of slopes for the finish edge 14. Removal of the bolt 38 allows the gage to be removed for cleaning purposes. The gage 26 can be adjusted so that the foot 30 is flush with the finish edge 14 or so that the foot 30 is above or below the finish edge. In preferred embodiments, the slots 34 and holes 32 are configured so that one end of the maximum range of the foot 30 places the foot 30 flush with the finish edge 14. Adjustments allow the foot 30 to be adjusted so that the finish edge 14 is below the foot, effectively creating more pitch. For example, slots in a preferred embodiment provide about 2" of relative movement between the foot 30 and the body 10. This creates a range of predetermined pitches with the foot 30 is above the finish edge 14 such that the predetermined pitch will be toward the opposite end 24 when the tool is used to pull a finish. In other preferred embodiments, a foot and gage form a permanently attached structure or unitary portion of the elongate body 12 with a foot being offset from the finish edge to provide a predetermined set pitch.

Figure 2:
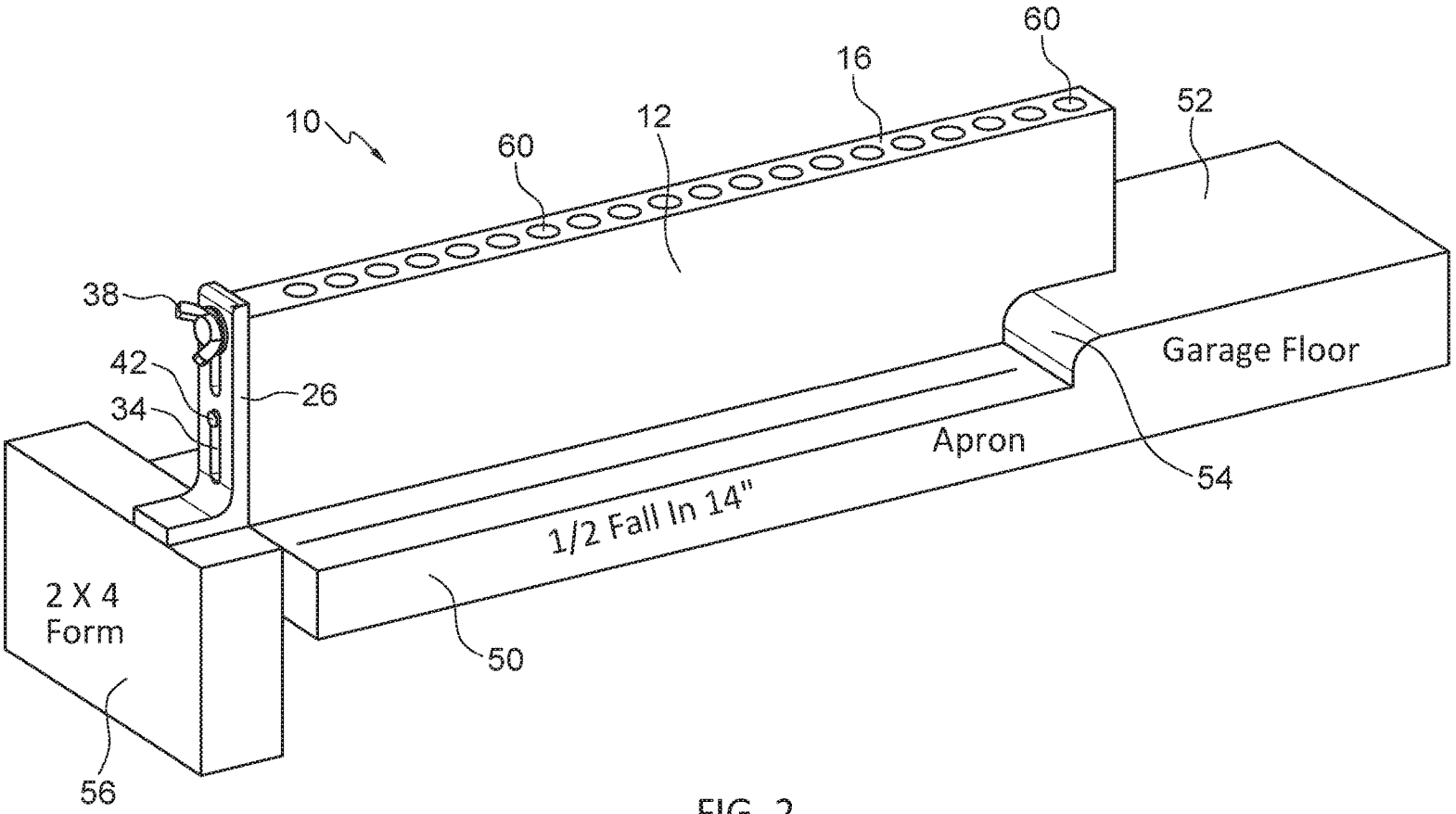
FIG. 2 is a perspective view of a preferred embodiment finishing tool of the invention set to a first pitch to finish an apron and the end of a garage floor.
Figure 3:
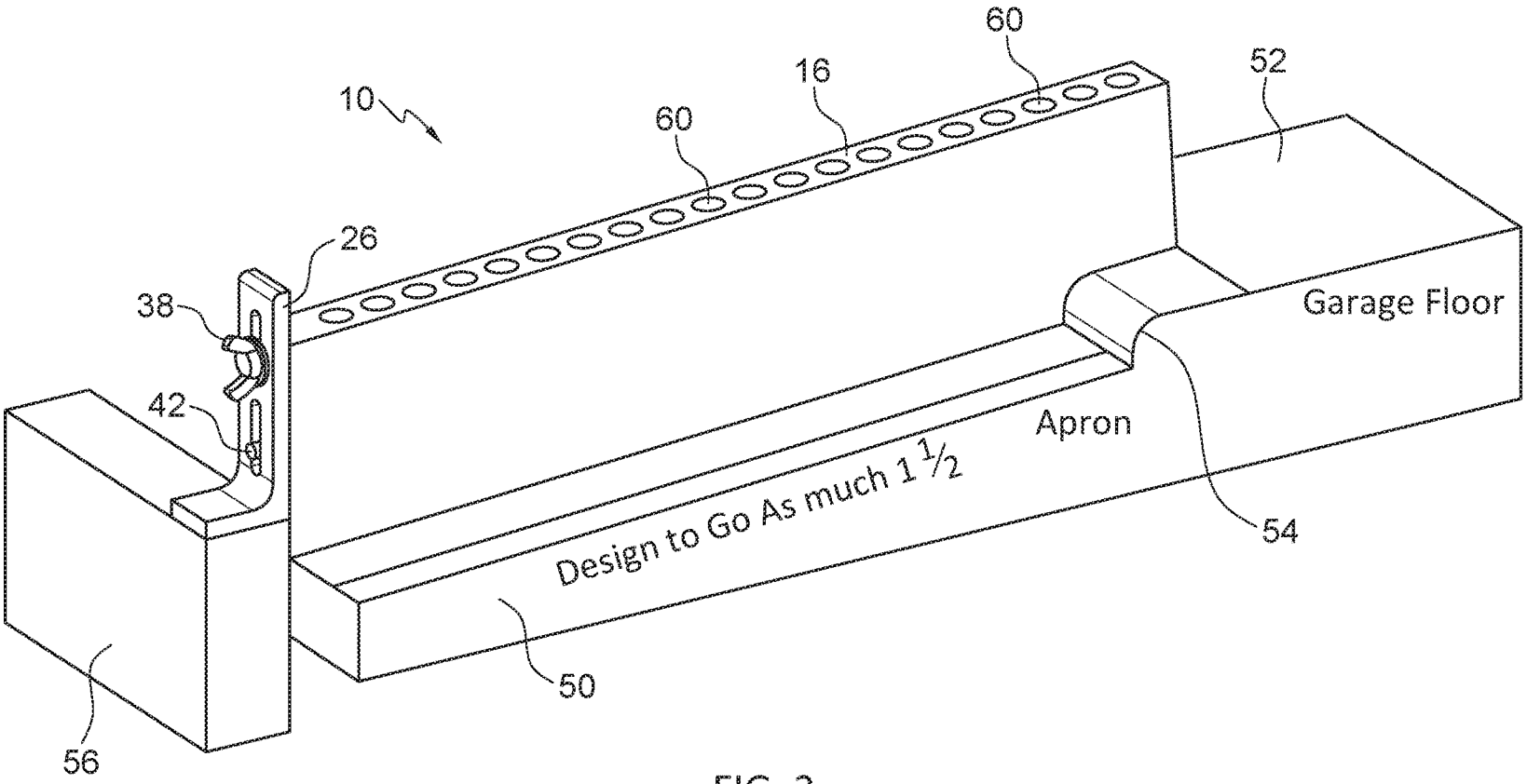
FIG. 3 is a perspective view of a preferred embodiment finishing tool of the invention set to a first pitch to finish an apron and the end of a garage floor.
Figure 4:
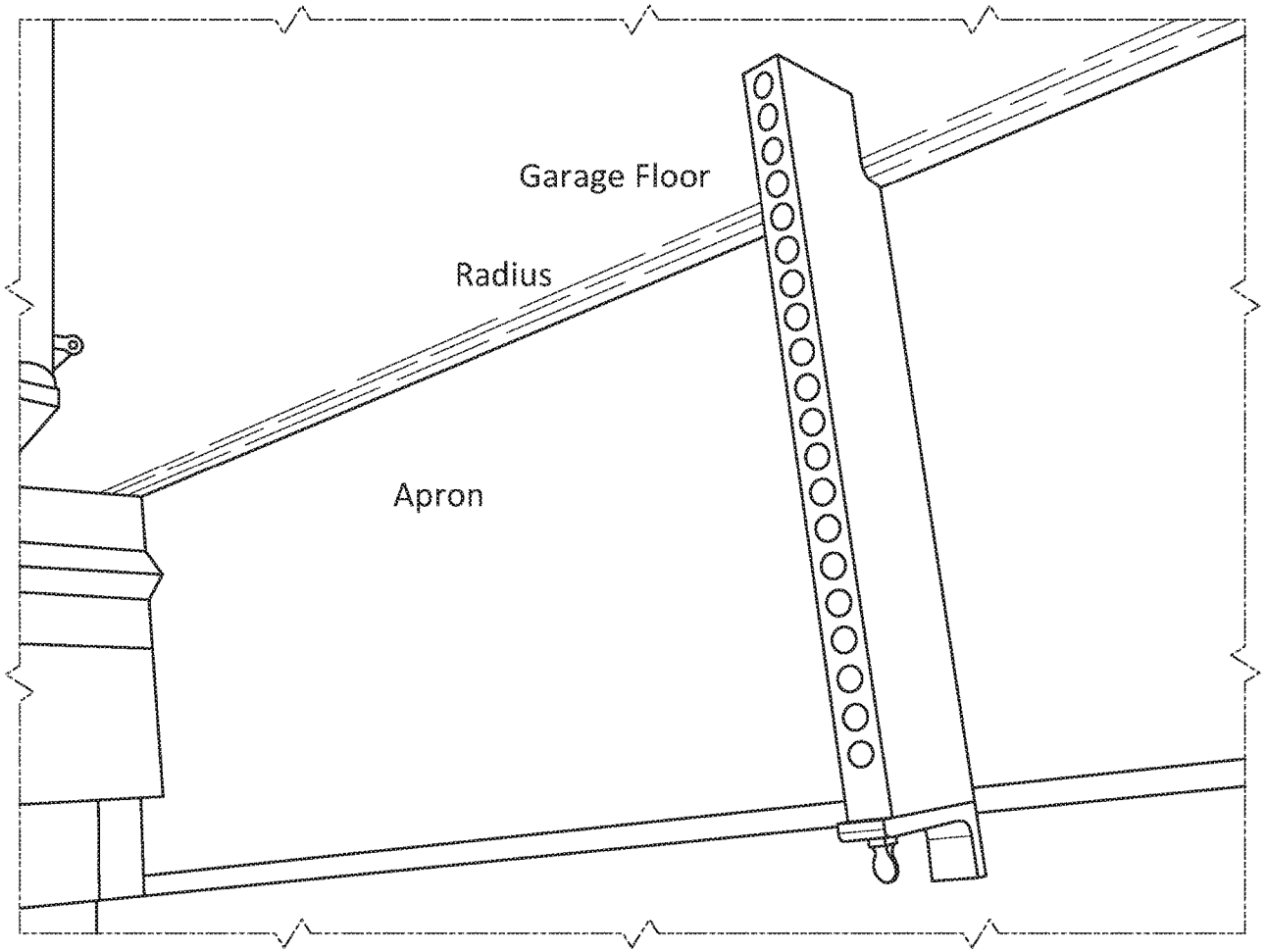
FIG. 4 is an image of a prototype finishing tool in accordance with the preferred embodiment of FIG. 1.

FIGS. 2-3 illustrate use and adjustment of the tool, and FIG. 4 a transition region formed between a garage floor and an apron with an experimental example tool of the invention, which has been tested and demonstrated to reliably form transitions as shown in FIG. 4 with reduced effort and more precision than conventional techniques that require a separate form for the apron and the floor portions.

As shown in FIGS. 2 and 3, the wing nut 38 and pin 42 with slots (which could also be separate holes) can be set to more than one position. This produces, for example, a predetermined pitch of ¼" in FIG. 2 and steeper pitch of ½" in FIG. 3 in an apron 50. An example embodiment can provide greater slopes, e.g. up to 1½" or more. The radius notch 18 itself can have a pitched surface to provide a stronger slope on the edge of a garage floor 52 and provides a rounded transition 54 from the garage floor, which is a first upper concrete surface, to the apron 50 that is a second lower surface as the foot 30 rides on a form 56. Other options for the gage include clamping and sliding gages, but have a plurality of fixed positions is preferred as the positions can provide specific predetermined desired pitch for an apron 50. The position of the foot 30 can be adjusted so that the foot is above the finishing edge, as shown in FIG. 3, which lowers the end of the finishing edge opposite from the radius notch 18 and provides a greater pitch in an apron 50 than compared to FIG. 2.

The body is preferably a hard, unitary plastic that is treated or inherently slippery (low friction) with respect to a material being finished by the tool, e.g., concrete. Other materials can also be finished with a tool and the materials for the tool can be selected accordingly. Another preferred material for the tool is a light metal alloy. In the case of any material, the tool 10 can include cylindrical hollows for reducing the weight. The body can be made of other materials, for example, hard polymers. Less preferred are materials that will absorb moisture, such as wood materials. Such porous and adsorbent tend to swell and are harder to clean up, which will limit the lifetime of the tool. Wood treatments can lessen the adsorbent tendencies of the wood and make wood more suitable for use as the tool.

The dimensions in FIG. 1 provide details or a preferred embodiment that is specifically designed for residential garage floors having a normally sized door assembly. The dimensions can be altered for these and other applications. The length of the finish edge and the radius and its curvature, along with the adjustment range of the gage provide the primary variables that will alter the finish that is achieved with use of the tool. FIG. 4 shows and example floor produced with an experimental tool of the invention.

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

The invention claimed is:

1. A finishing tool, the tool comprising:

an elongate body having a finish side and a grip side, the finish side providing a finish edge configured to form a flat concrete surface when pulled across partially set concrete, the grip side being configured to be gripped by a user;

a radius notch on one end of the finish side configured to provide a rounded edge transition above the flat concrete surface when pulled across the partially set concrete, wherein the finish edge is configured to be sloped running away from the radius notch;

an adjustable form gage attached to an opposite end of said elongate body from said radius notch, the adjustable form gage comprising a foot with a form surface configured to interface with a form and being adjustable within a predetermined range to set the finish edge at a predetermined pitch, wherein the predetermined range includes a position where the foot is above the finish edge such that the predetermined pitch will be toward the opposite end when the tool is used to pull a finish, wherein the adjustable form gage comprises two slots to accommodate a bolt and/or a pin and the tool further comprises holes in said opposite end to accommodate the bolt and/or pin and the bolt and/or pin sized to fit in said holes.

2. The tool of claim 1, wherein said elongate body comprises a metal alloy.

3. The tool of claim 2, wherein said elongate body consists of a unitary, single piece of metal alloy.

4. The tool of claim 1, wherein said elongate body comprises a hard plastic or polymer.

5. The tool of claim 4, wherein said elongate body consists of a unitary, single piece of hard plastic or polymer.

6. The tool of claim 1, wherein said radius comprises a sloped surface.

7. The tool of claim 1, comprising a foot offset from the finish edge and at an opposite end of said elongate body from said radius notch.

8. A finishing tool, the tool comprising:

an elongate body having a finish side and a grip side, the finish side providing a finish edge configured to form a flat concrete surface when pulled across partially set concrete, the grip side being configured to be gripped by a user;

a radius notch on one end of the finish side configured to provide a rounded edge transition above the flat concrete surface when pulled across the partially set concrete, wherein the finish edge is configured to be sloped running away from the radius notch; and an adjustable form gage attached to an opposite end of said elongate body from said radius notch, wherein adjustable form gage is adjustable between a plurality of specific positions set by a plurality holes on the opposite end, at least one of which is threaded to cooperate with a bolt to permit attachment of the gage, the gage further comprising one or more slots to permit attachment of the gage at a plurality of positions relative to said elongate body and said finish edge.

9. The tool of claim 8, wherein said elongate body comprises a metal alloy.

10. The tool of claim 9, wherein said elongate body consists of a unitary, single piece of metal alloy.

11. The tool of claim 8, wherein said elongate body comprises a hard plastic or polymer.

12. The tool of claim 11, wherein said elongate body consists of a unitary, single piece of hard plastic or polymer.

13. The tool of claim 8, wherein said radius comprises a sloped surface.

14. The tool of claim 8, comprising a foot offset from the finish edge and at an opposite end of said elongate body from said radius notch.

* * * * *